US006685066B2

(12) United States Patent
Cragg

(10) Patent No.: US 6,685,066 B2
(45) Date of Patent: Feb. 3, 2004

(54) QUICK-ATTACH ARRANGEMENT FOR THIGH RIG

(76) Inventor: James Victor Cragg, 5290 W. Wahington Blvd., Los Angeles, CA (US) 90016

( * ) Notice: Subject to any disclaimer, the term of this patent is extended or adjusted under 35 U.S.C. 154(b) by 0 days.

(21) Appl. No.: 10/057,120

(22) Filed: Jan. 28, 2002

(65) Prior Publication Data

US 2003/0141328 A1 Jul. 31, 2003

(51) Int. Cl.[7] ..... F41C 33/02; F42B 39/02; A45C 1/04; A45F 3/00; B65D 1/00

(52) U.S. Cl. ..... 224/192; 224/198; 224/199; 224/238; 224/243; 224/661; 224/911

(58) Field of Search ..... 224/192, 198, 224/911, 199, 243, 247, 236, 238, 655, 659, 666; 206/315.11, 317

(56) References Cited

U.S. PATENT DOCUMENTS 3,003,670 A * 10/1961 Stella ..... 224/2
D264,240 S * 5/1982 Bianchi ..... 224/192 X
D283,043 S * 3/1986 Pitts ..... 224/192 X
4,886,197 A * 12/1989 Bowles et al. ..... 224/243
4,898,310 A * 2/1990 Remington ..... 224/238
5,215,238 A * 6/1993 Baruch ..... 224/243
5,236,113 A * 8/1993 Wisser ..... 224/243
5,445,303 A * 8/1995 Cawile, Jr. ..... 224/222
5,480,077 A * 1/1996 Eng ..... 224/243
5,489,053 A * 2/1996 Davis ..... 224/243
5,893,496 A * 4/1999 Katz et al. ..... 224/901 X
6,155,471 A * 12/2000 Lichtenberger ..... 224/626

* cited by examiner

*Primary Examiner*—Sue A. Weaver
(74) *Attorney, Agent, or Firm*—Raymond Y. Chan; David and Raymond Patent Group

(57) ABSTRACT

A thigh rig includes a carrier and a quick-attach arrangement. The carrier includes a pad body, having a front side and a rear side, for detachably attaching on a user's body and a pouch panel overlappedly provided on the front side of the pad body to define a storage compartment, for receiving a pistol-like weapon therein, between the pad body and the pouch panel. The storage compartment has a top opening having a holding portion formed by a top edge of the pouch panel. The quick-attach arrangement includes a pair of reinforcing elements spacedly provided at the top opening of the storage compartment for selectively adjusting a width of the holding portion of the top opening, so as to securely hold a wrist of the weapon in the storage compartment in position.

2 Claims, 6 Drawing Sheets

QUICK-ATTACH ARRANGEMENT FOR THIGH RIG

BACKGROUND OF THE PRESENT INVENTION

1. Field of Invention

The present invention relates to a thigh rig, and more particular to a quick-attach arrangement for a thigh rig, which provides a quick-attachable holster on the user's body with ambidextrous ability.

2. Description of Related Arts

The duty of a police officer is to keep the public order. During the protest movement, such as protest march, demonstration, or even riot, the police officers must be on the alert and usually armed to prevent an unexpected incident since any one of the demonstrators can be a potential offender. Sometimes, the officer may put down the riot by force. In order to minimize an unwanted injury and against attack, the police officer will not only carry the pistol but also carry other kinds of weapons such as taser or stagger gun at the same time.

In other words, the officer must carry many rigs in one single action, which may reduce the mobility of the officer. Thus, in order to load the weapons quickly, a holster is usually used to carry the weapon such that the officer can quickly load up the holster with the weapon within seconds during such crucial situation. As the officer's belt is already cluttered, the holster needs to be versatile in its mounting systems and comfortable. However, the conventional holster is specifically designed for either a right-hand user or a left-hand user that allows the user to effectively withdraw the weapon in a quick responding manner. Therefore, the officer must carefully to pick the corrected holster that fits his or her preference.

The major drawback of the conventional holster is that the holster is tailor-made to fit the corresponding weapon. Since there are different kinds and sizes of weapon, the conventional holster having a predetermined shape and size may not fit for other size of the weapon. It is a hassle for the user to find the corresponding holster which can not only be quickly loaded on the user's body but also securely hold the weapon. If an unmatched holster is used, the holster cannot protect the weapon from close quarters grappling.

SUMMARY OF THE PRESENT INVENTION

A main object of the present invention is to provide a quick-attach arrangement for thigh rig, which provides a quick-attachable holster on the user's body without reducing the mobility of the user.

Another object of the present invention is to provide a quick-attach arrangement for thigh rig, which provides an ambidextrous ability to fit both the right-hand user and the left-hand user.

Another object of the present invention is to provide a quick-attach arrangement for thigh rig, which comprises a pair of reinforcing elements for selectively adjusting a width of the top opening of the storage compartment such that any size of the pistol-like weapon can be fittedly held in the storage compartment in a secure manner.

Another object of the present invention is to provide a quick-attach arrangement for thigh rig, which can protect the weapon from public sight, damaging abrasions, and close quarters grappling.

Another object of the present invention is to provide a quick-attach arrangement for thigh rig, which provides full flapped protection and retention for law enforcement use.

Accordingly, in order to accomplish the above objects, the present invention provides a thigh rig, which comprises:

a carrier comprising a pad body, having a front side and a rear side, for detachably attaching on a user's body and a pouch panel overlappedly provided on the front side of the pad body to define a storage compartment, for receiving a pistol-like weapon therein, between the pad body and the pouch panel, wherein the storage compartment has a top opening defined at a top edge of the pouch panel and the front side of the pad body; and a quick-attach arrangement comprising a pair of reinforcing elements spacedly provided at the top opening of the storage compartment for selectively adjusting a width of the top opening, so as to securely hold the weapon in the storage compartment in position.

DETAILED DESCRIPTION OF THE PREFERRED EMBODIMENT

Figure 1:
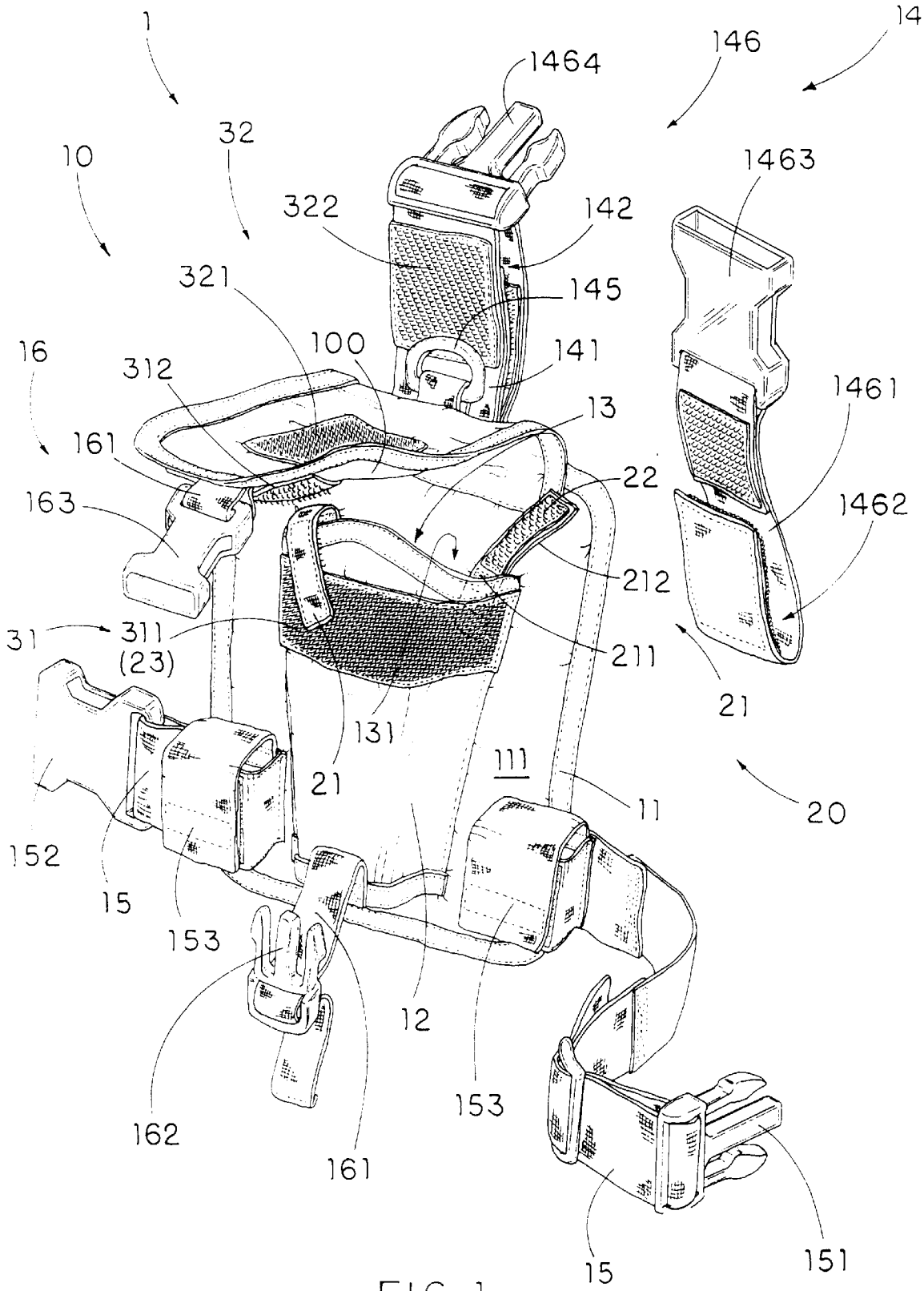
FIG. 1 is a front perspective view of a thigh rig with a quick-attach arrangement according to a preferred embodiment of the present invention.
Figure 2:
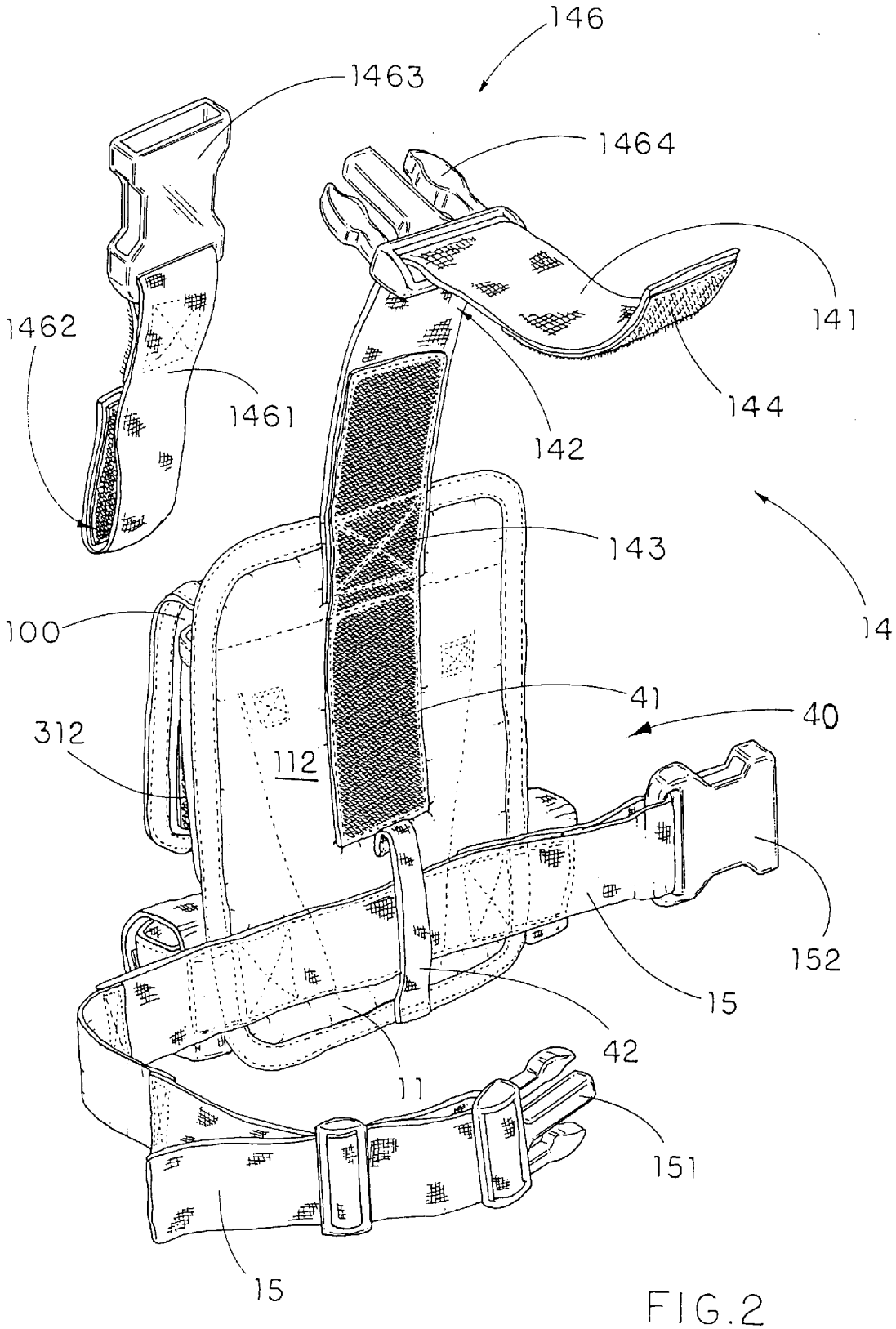
FIG. 2 is a rear perspective view of the thigh rig with the quick-attach arrangement according to the above preferred embodiment of the present invention.

Referring to FIGS. 1 and 2 of the drawings, a thigh rig 1 employed with a quick-attach arrangement 20 according to a preferred embodiment of the present invention is illustrated, which is adapted for securely holding a pistol-like weapon such as pistol, taser, stagger gun or the like.

The thigh rig 1 comprises a carrier 10 which comprises a pad body 11, having a front side 111 and a rear side 112, for detachably attaching on a user's body and a pouch panel 12 overlappedly provided on the front side 111 of the pad body 11 to define a storage compartment 13, for receiving a pistol-like weapon therein, between the pad body 11 and the pouch panel 12, wherein the storage compartment 13 has a top opening 131, having a holding portion, formed by a top edge of the pouch panel 12 and the front side 111 of the pad body 11.

The quick-attach arrangement 20 comprises a pair of reinforcing elements 21 spacedly provided at the top opening 131 of the storage compartment 13 for selectively adjusting a width of the holding portion of the top opening 131, so as to securely hold a wrist of the weapon in the storage compartment 13 in position.

The weapon generally comprises an elongated tubular portion, a trigger guard portion, and a gripping portion wherein the wrist of the weapon is defined between the trigger guard portion and the gripping portion. It is worth to mention that any conventional holster must hold the wrist of the weapon tightly in order to hold the weapon in position, so as to prevent an unwanted movement of the weapon with respect to the conventional holster.

Each of the reinforcing elements 21, which is an elongated strap, has an affixing end 211 affixed on the front surface 111 of the pad body 11 and a control portion 212 extended across the top opening 131 of the storage compartment 13 to fasten on the pouch panel 12 for selectively adjust the holding portion of the top opening 131, so as to tighten the weapon at the wrist thereof.

In order to securely hold the reinforcing elements 21 in position, the quick-attach arrangement 20 further comprises a first fastener 22 provided on an inner side of the control portion 212 of each of the reinforcing elements 21 and a second fastener 23 provided on an outer side of the pouch panel 12 such that the control portion 212 of each of the reinforcing elements 21 is adapted to securely attach on the pouch panel 12 by detachably fastening the first fastener 22 with the second fastener 23.

Accordingly, the first and second fasteners are hoop and loop fasteners affixed on the inner side of the control portion 212 of each of the reinforcing elements 21 and the outer side of the pouch panel 12 respectively. Therefore, by adjusting various fastening positions of the control portion 212 of the reinforcing element 21 on the pouch panel 12, the width of the top opening 131 of the storage compartment 13 can be altered to hold various sizes and shapes of the weapon.

Figure 3A:
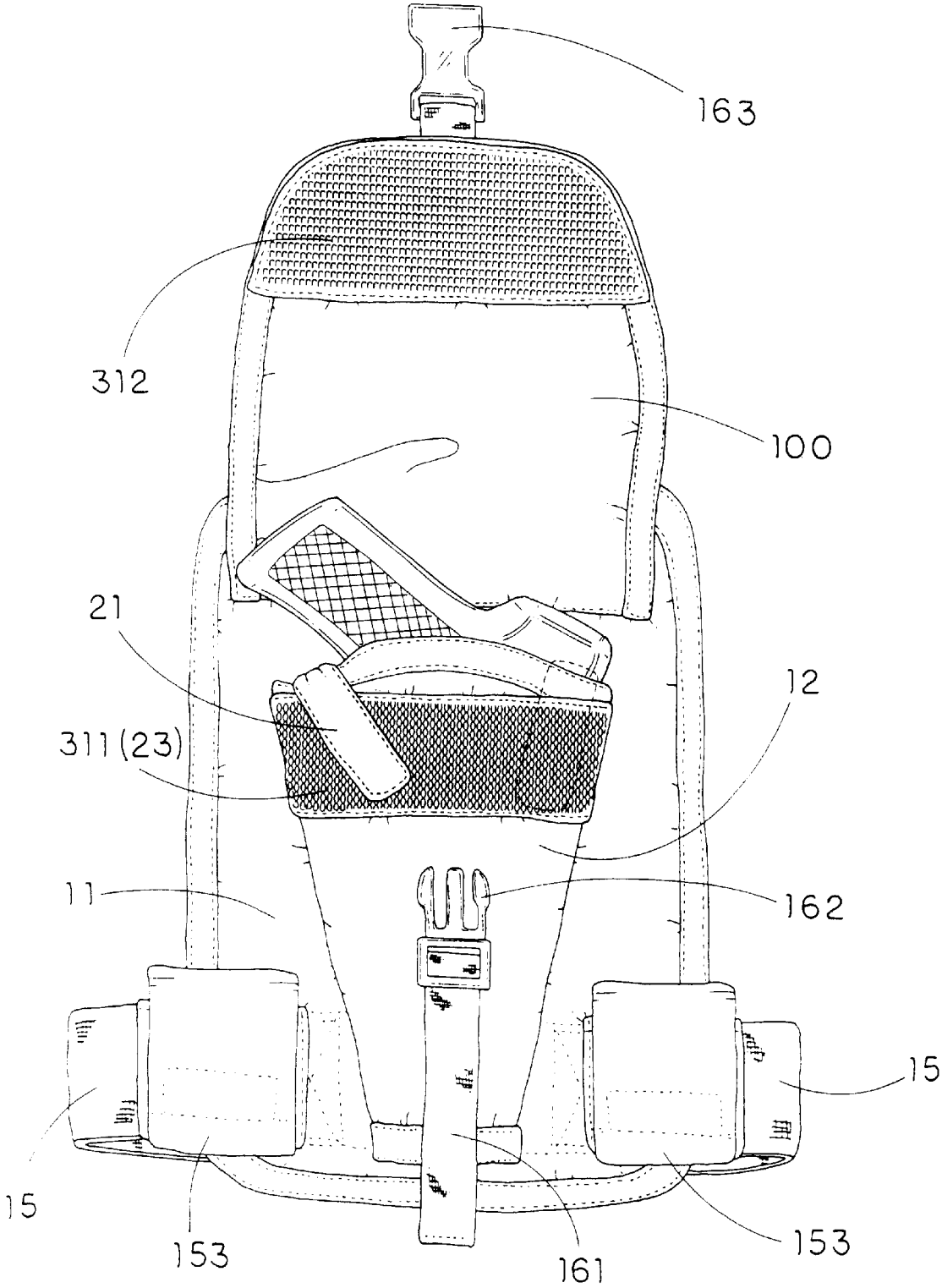
FIGS. 3A through 3D illustrate a utility of the quick-attach arrangement according to the above preferred embodiment of the present invention.
Figure 3B:
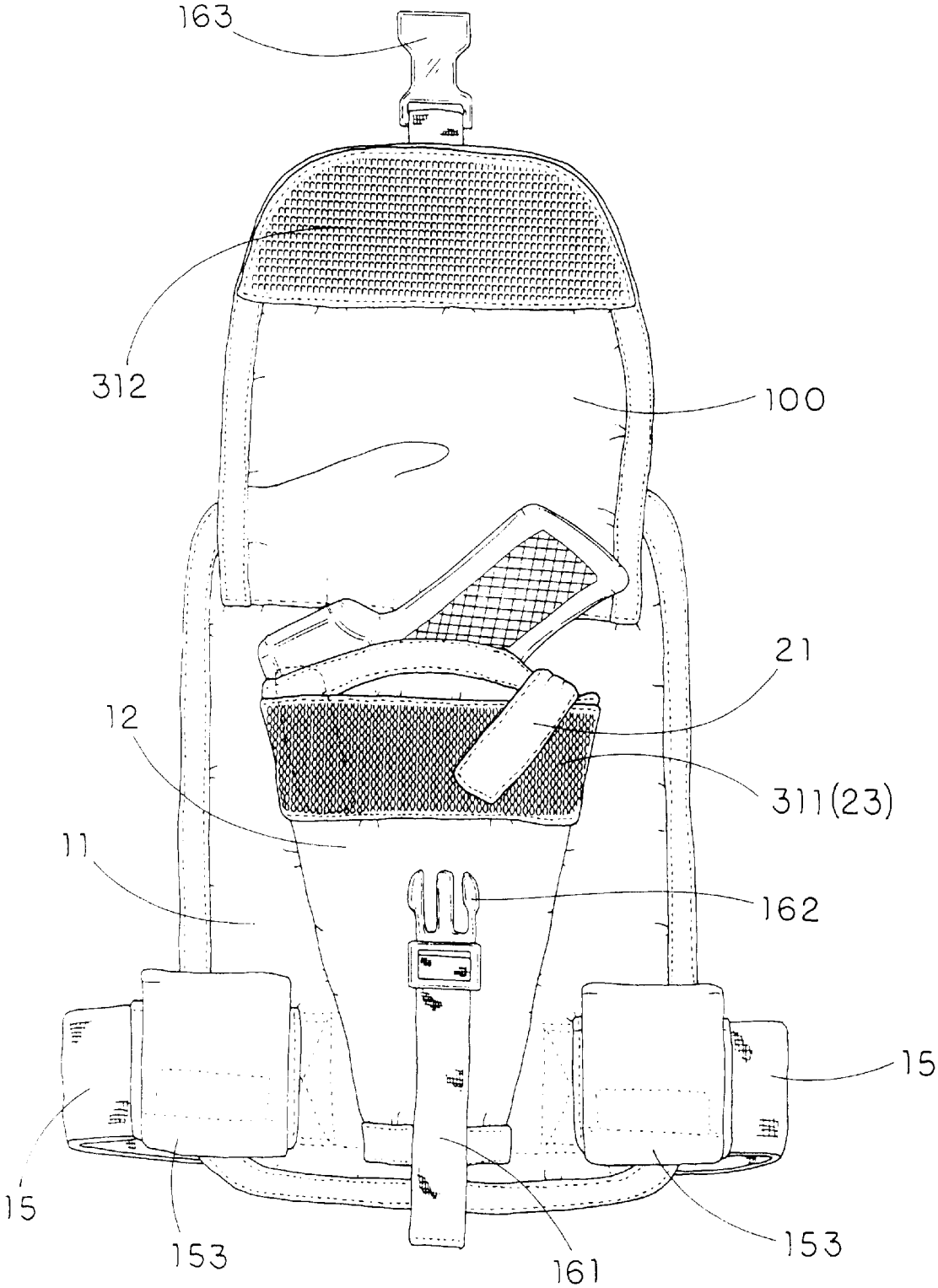

As shown in FIG. 3A, when the first reinforcing element 21 is attached on the pouch panel 12 while the second reinforcing element 21 is remain unattached, the thigh rig 1 of the present invention can hold the weapon for a right-hand user. Similarly, when the second reinforcing element 21 is attached on the pouch panel 12 while the first reinforcing element 21 is remain unattached, the thigh rig 1 of the present invention can hold the weapon for a left-hand user, as shown in FIG. 3B.

Figure 3C:
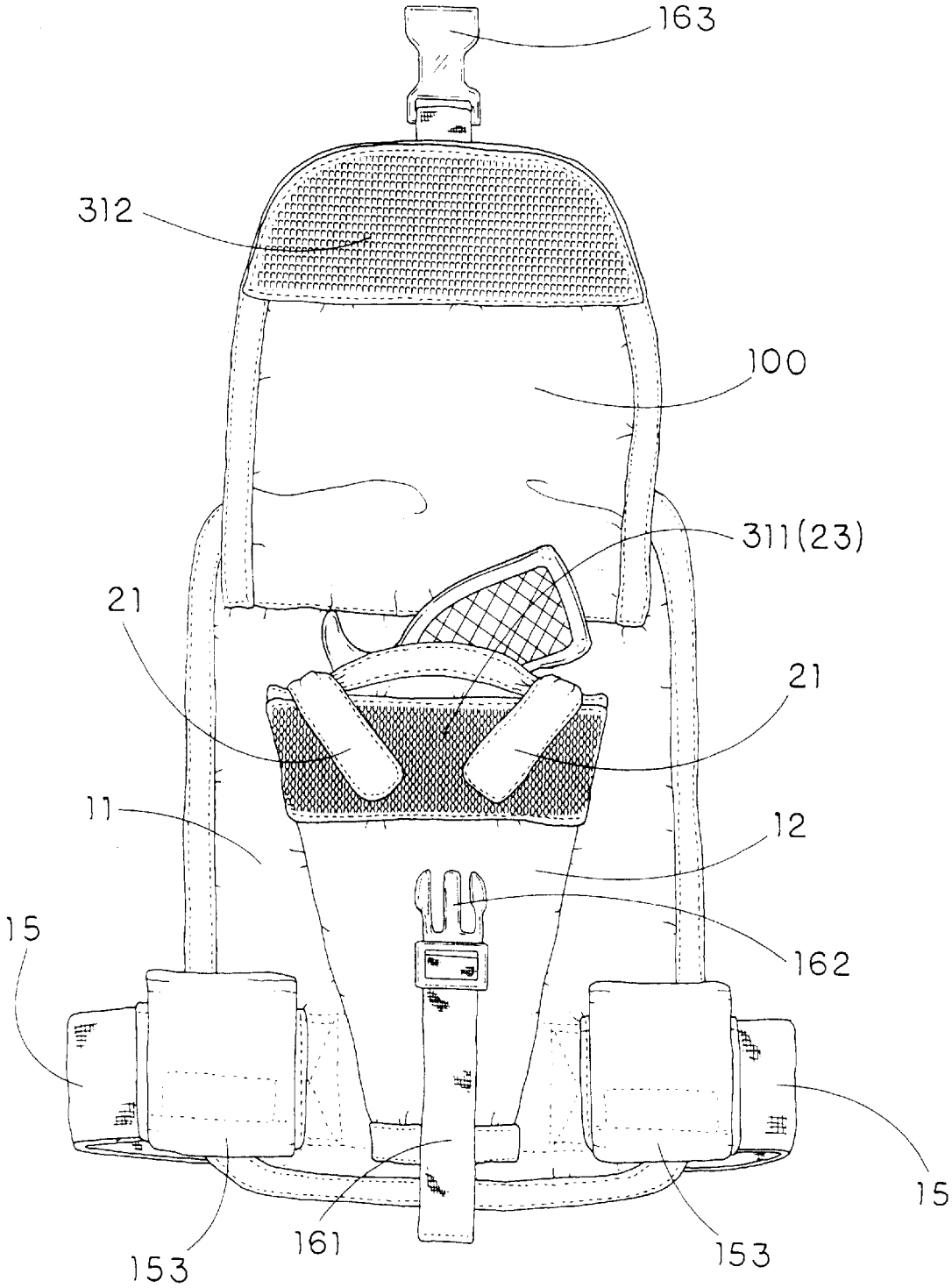
Figure 3D:
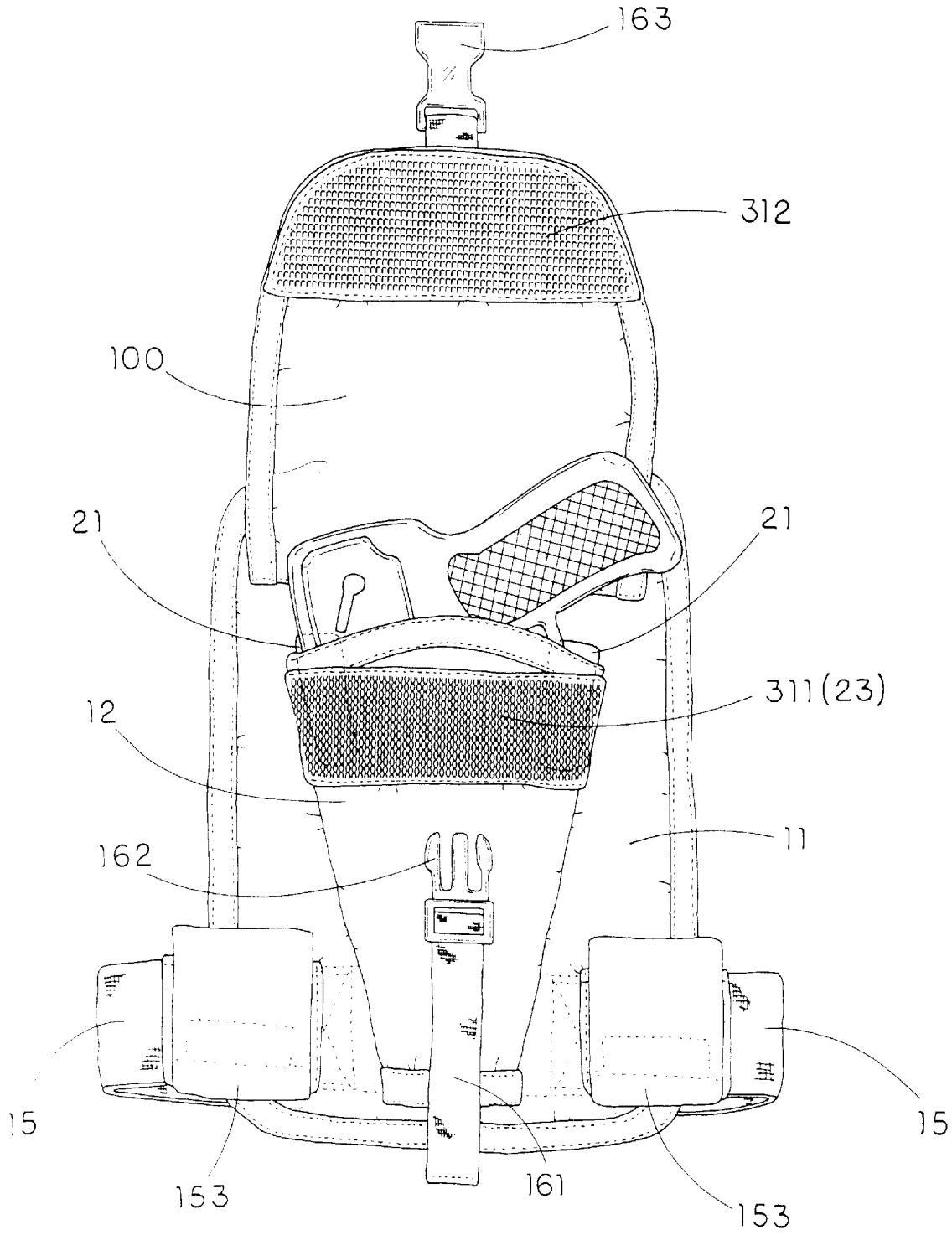

The thigh rig 1 of the present invention can also hold different sizes of the weapon by manipulating with the two reinforcing elements 21. As shown in FIG. 3C, when both the two reinforcing elements 21 are attached on the pouch panel 12, the top opening 131 of the storage compartment 13 will be substantially reduced to hold the weapon having a smaller size. When none of the two reinforcing elements 21 are attached on the pouch panel 12, the top opening 131 of the storage compartment 13 will retain its maximum width for holding the weapon having a bigger size, as shown in FIG. 3D. In other words, the present invention provides not only an ambidextrous ability to fit both the right-hand user and the left-hand user but also a self-adjusting configuration to securely hold the weapon with various sizes.

According to the preferred embodiment, the carrier 10 further comprises a shielding flap 100, having a predetermined size and shape, is overlappedly extended from the pad body 11 for enclosing the top opening 131 of the storage compartment 13 so as to cover a butt of the weapon. The shielding flap 111 has a longitudinal edge affixed to the pad body 11 by stitching wherein the shielding flap 100 is adapted to overlappedly fold down to enclose the top opening 131 of the storage compartment 13 so as to cover on the pouch panel 12. Therefore, the shielding flap 100 can minimize the exposure of the weapon in public.

The pad body 11 is made of durable material such as nylon wherein a cushioned layer is provided between the front side 111 and the rear side 112 of the pad body 11 so as to provide a comfort touching when the pad body 11 is fastened on the user's body.

The pouch panel 12, having a triangular shaped, has two side edges firmly affixed on the front side 111 of the pad body 11 by stitching to form the storage compartment 13 between the pouch panel 12 and the pad body 11 wherein the storage compartment 13 has a cross section area gradually reducing from a top portion to a bottom portion, such that the storage compartment 12 is shaped and sized to fit the weapon receiving therein.

It is worth to mention that two sloping sidewall of the storage compartment 13 will support the weapon in a canting position with respect to the pad body 11. When the weapon is received in the storage compartment 13 and locked up by the reinforcing element 21, a top side of the weapon is forced to bias against the respective sidewall of the storage compartment 13, so as to support the weapon in an inclined position. Therefore, the weapon in such canting position is adapted to enhance the withdrawing action for the user.

The top opening 131 of the storage compartment 13 is defined by a top edge of the pouch panel 12 and the front side 111 of the pad body 11 wherein the top edge of the pouch panel 12 has a curved shape gradually descending from a mid-portion of the top edge to two side edges thereof, so as to enhance a retention of weapon in the storage compartment 13.

The carrier 10 further comprises a securing unit 16 comprising a first and second securing straps 161 extended from the pouch panel 20 and the shielding flap 100 respectively, a buckle plug 162 provided at a free end of the first securing strap 161, and a corresponding buckle socket 163 provided at a free end of the second securing strap 161, so that the shielding flap 100 is substantially protect the weapon by detachably buckling up the buckle plug 162 and the buckle socket 163. Therefore, the securing unit 16 enhances the shielding flap 100 to protect the weapon from close quarters grappling. It is worth to mention that the buckle plug 162 and the buckle socket 163 can be replaced by other fasteners such as hoop and loop fasteners, snap fasteners, straps with cinch or such similar attachment for fastening two members together.

The carrier 10 further comprises a belt hanger 14 upwardly extended from a top edge of the pad body 11 and a pair of leg straps 15 extended from two opposed side edges of the pad body 11.

Accordingly, the belt hanger 14 comprises an elongated durable belt 141 having an affixing end affixed to the pad body 11 and a free end, wherein the belt hanger 14 is formed by folding the durable belt 141 overlappedly to form a hanging loop 142. A pair of fasteners 143, 144 are provided at the affixing end portion and the free end portion of the durable belt 141 such that the free end portion of the durable belt 141 is adapted to detachably attach to the affixing end portion thereof to form the hanging loop 142 by attaching the pair of fasteners 143, 144 with each other. Therefore, the user is able to hang the carrier 10 at the waist portion by passing the user's waist belt through the hanging loop 142 of the belt hanger 14.

In order to substantially hold the shielding flap 100 in position, a first pair of holding elements 31 is provided on the pouch panel 12 and the shielding flap 100 respectively and a second pair of holding elements 32 is provided on the shielding flap 100 and the belt hanger 14 respectively.

Accordingly, the first pair of holding elements 31 is a pair of hoop and loop fasteners 311, 312 provided on an outer side of the pouch panel 12 and an inner side of the shielding flap 100 respectively in such a manner that the shielding flap 100 is adapted to securely enclose the storage compartment 13 in a closed position by detachably fastening the first pair of holding elements 31 together, as shown in FIG. 2.

The second pair of holding elements 32 is a pair of hoop and loop fasteners 321, 322 provided on an outer side of the shielding flap 100 and an outer side of the belt hanger 14 in such a manner that the shielding flap 100 is adapted to fold upward and hold by the belt hanger 14 in an opened position by detachably fastening the second pair of holding element 32 together so as to communicate the storage compartment 13 with outside, as shown in FIG. 3. In other words, in the opened position, the shielding flap 100 is held by the carrier 10 such that the user is able to withdraw the weapon from the thigh rig 1 of the present invention efficiently without interfering by the shielding flap 100, especially when the user is in an alert situation.

It is worth to mention that the first holding element 311 is embodied as the same as the second fastener 23 of the quick-attach arrangement 20 since the first holding element 311 and the second fastener 23 are provided on the outer side of the pouch panel 12 of the carrier 10 for fastening purpose, as shown in FIG. 1.

The belt hanger 14 further comprises hanging ring 145 and a belt adapter 146. The hanging ring 145 is provided at the top edge of the pad body 11 such that the carrier 10 can be detachably mounted on the user's uniform by detachably connecting the hanging ring 145 with a uniform buckle or waist belt provided on the user's uniform.

The belt adapter 146 comprises a hanging belt 1461 overlappedly folded by detachably attaching two end portions thereof with each other to form a holding loop 1462, a first adapter 1463 having a through slot for the hanging belt 1461 slidably passing through, and a second adapter 1464 having a through slot for the durable belt 141 slidably passing through and arranged to detachably attach to the first adapter 1463. Therefore, the user is able to pre-mount the belt adapter 146 on his or her waist portion by passing the user's waist belt through the holding loop 1462 and then simply attach the second adapter 1464 to the first adapter 1463 so as to quickly and securely mount the carrier 10 at the waist portion of the user.

As shown in FIG. 1, the two leg straps 15 are affixed to two opposed side edges of the pad body 11 wherein a leg buckle plug 151 and a leg buckle socket 152 are provided at free ends of the two leg straps 15 respectively and detachably connected with each other, so that the carrier 10 can be further firmly mounted on the thigh of the user by wrapping the leg straps 15 around the thigh of the user and buckling up the leg buckle plug 151 and the leg buckle socket 152. Each of the leg straps 15 further comprises an auxiliary pouch 153 affixed to the leg strap 15 for carrying weapon accessories such as cartridge or bullet.

The thigh rig 1 further comprises an attaching unit 40 for detachably attaching the pad body 11 to the user's body, wherein the attaching unit 40 comprises at least a fastening element 41 provided on the rear side 112 of the pad body 11 for detachably attaching to the user's uniform. Accordingly, the fastening element 41 can be a hoop fastener, loop fastener, or both hoop and loop fasteners, as shown in FIG. 2, affixed to the rear side 112 of the pad body 11. The attaching unit 40 further comprises at least a fastening strap 42 having two ends affixed to the rear side 112 of the pad body 11 such that the user's uniform having a corresponding thigh strap is adapted to fasten to the fastening strap 42 by passing the thigh belt between the fastening strap 42 and the pad body 11. In other words, the thigh rig 1 of the present invention having various attaching modes can be detachably mount on the user's thigh position by fastening the attaching unit 40 to the corresponding fastening element or thigh strap provided on the thigh portion of the user's uniform.

What is claimed is:

1. A thigh rig, comprising:

a carrier comprising a pad body, having a front side and a rear side, for detachably attaching on a user's body and a pouch panel overlappedly provided on said front side of said pad body to define a storage compartment, for receiving a pistol-like weapon therein, between said pad body and said pouch panel, wherein said storage compartment has a top opening, having a holding portion, formed by a top edge of said pouch panel and said front side of the pad body, wherein said carrier further comprises a belt hanger which is upwardly extended from a top edge of said pad body and comprises an elongated durable belt having an affixing end affixed to said pad body and a free end, wherein said belt hanger is formed by folding said durable belt overlappedly to form a hanging loop, a pair of fasteners being provided at said affixing end portion and said free end portion of said durable belt such that said free end portion of said durable belt is adapted to detachably attach to said affixing end portion thereof to form said hanging loop by attaching said pair of fasteners with each other, wherein said belt hanger further comprises a belt adapter which comprises a hanging belt overlapped folded by detachably attaching two end portions thereof with each other to form a holding loop, a first adapter having a through slot for said hanging belt slidably passing through, and a second adapter having a through slot for said durable belt slidably passing through and arranged to detachably attach to said first adapter, so as to quickly mount pad body to said belt adapter; and a quick-attach arrangement comprising a pair of reinforcing elements spacedly provided at said top opening of said storage compartment for selectively adjusting a width of the holding portion of said top opening, so as to securely hold a wrist of said weapon in said storage compartment in position, wherein each of said reinforcing elements, which is an elongated strap, has an affixing end affixed on said front surface of said pad body and a control portion extended across said top opening of said storage compartment to fasten on said pouch panel for selectively adjust said holding portion of said top opening, so as to tighten said weapon at said wrist thereof.

2. A thigh rig, comprising:

a carrier comprising a pad body, having a front side and a rear side, for detachably attaching on a user's body and a pouch panel overlappedly provided on said front side of said pad body to define a storage compartment, for receiving a pistol-like weapon therein, between said pad body and said pouch panel, wherein said storage compartment has a top opening, having a holding portion, formed by a top edge of said pouch panel and said front side of the pad body, wherein said carrier further comprises a shielding flap, having a predetermined size and shape, is overlappedly extended from said pad body for enclosing said top opening of said storage compartment so as to cover a butt of said weapon, wherein said carrier further comprises a belt hanger, which is upwardly extended from a top edge of said pad body, comprising an elongated durable belt having an affixing end affixed to said pad body and a free end, wherein said belt hanger is formed by folding said durable belt overlappedly to form a hanging loop, a pair of fasteners being provided at said affixing end portion and said free end portion of said durable belt such that said free end portion of said durable belt is adapted to detachably attach to said affixing end portion thereof to form said hanging loop by attaching said pair of fasteners with each other, wherein said belt hanger further comprises a belt adapter which comprises a hanging belt overlapped folded by detachably attaching two end portions thereof with each other to form a holding loop, a first adapter having a through slot for said hanging belt slidably passing through, and a second adapter having a through slot for said durable belt slidably passing through and arranged to detachably attach to said first adapter, so as to quickly mount pad body to said belt adapter; and a quick-attach arrangement comprising a pair of reinforcing elements spacedly provided at said top opening of said storage compartment for selectively adjusting a width of the holding portion of said top opening, so as to securely hold a wrist of said weapon in said storage compartment in position, wherein each of said reinforcing elements, which is an elongated strap, has an affixing end affixed on said front surface of said pad body and a control portion extended across said top opening of said storage compartment to fasten on said pouch panel for selectively adjust said holding portion of said top opening, so as to tighten said weapon at said wrist thereof, wherein said quick-attach arrangement further comprises a first fastener provided on an inner side of said control portion of each of said reinforcing elements and a second fastener provided on an outer side of said pouch panel such that said control portion of each of said reinforcing elements is adapted to securely attach on said pouch panel by detachably fastening said first fastener with said second fastener.

* * * * *